US006828498B2

(12) United States Patent
Sugiyama et al.

(10) Patent No.: US 6,828,498 B2
(45) Date of Patent: Dec. 7, 2004

(54) AUDIO SIGNAL OUTPUTTING METHOD, AUDIO SIGNAL REPRODUCTION METHOD, AND COMPUTER PROGRAM PRODUCT

(75) Inventors: Keiichi Sugiyama, Tokyo (JP); Mitsuru Takahashi, Tokyo (JP); Keiichi Noda, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 56 days.

(21) Appl. No.: 10/267,832

(22) Filed: Oct. 10, 2002

(65) Prior Publication Data

US 2003/0070538 A1 Apr. 17, 2003

(30) Foreign Application Priority Data

Oct. 11, 2001 (JP) ..... 2001-314598

(51) Int. Cl.[7] ..... G10H 7/00
(52) U.S. Cl. ..... 84/645
(58) Field of Search ..... 84/609, 610, 634, 84/645

(56) References Cited

U.S. PATENT DOCUMENTS 5,386,081 A 1/1995 Nakada et al.
5,679,913 A 10/1997 Bruti et al.
5,890,017 A * 3/1999 Tulkoff et al. ..... 710/65
5,902,947 A 5/1999 Burton et al.
6,008,446 A * 12/1999 Van Buskirk et al. ..... 84/603
6,093,880 A * 7/2000 Arnalds ..... 84/464 R
6,489,549 B2 * 12/2002 Schmitz et al. ..... 84/609

FOREIGN PATENT DOCUMENTS

EP 1 041 536 A1 10/2000
EP 1 094 441 A1 4/2001

* cited by examiner

*Primary Examiner*—Jeffrey W Donels
(74) *Attorney, Agent, or Firm*—Finnegan, Henderson, Farabow, Garrett & Dunner, L.L.P.

(57) ABSTRACT

An object of the present invention is to provide a technology for switching the output of an audio signal at timing where there is a musical break. To achieve this object, the present invention captures the musical piece progress timing for each MIDI message of multiple channels, mutually synchronized musically, and, upon detection of the occurrence of an event which changes the reproduced and outputted audio signal, reproduces and outputs an audio signal by selecting from above-mentioned plurality of MIDI messages a combination of MIDI messages corresponding to above-mentioned event, selection being made at a timing where there is a musical break.

13 Claims, 3 Drawing Sheets

EVENT TABLE

| EVENT | MUTING OPERATOR | VIBRATION PATTERN |
|---|---|---|
| EVENT 1 | 1011 | vb4 |
| EVENT 2 | 1100 | vb2 |
| EVENT 3 | 0010 | vb1 |
| EVENT 4 | 0011 | vb3 |

MUTING TABLE

| ch1 | ch2 | ch3 | ch4 |
|---|---|---|---|
| 1 | 0 | 0 | 1 |

AUDIO SIGNAL OUTPUTTING METHOD, AUDIO SIGNAL REPRODUCTION METHOD, AND COMPUTER PROGRAM PRODUCT

BACKGROUND OF THE INVENTION

1. Field of the Invention

The present invention relates to an audio signal outputting technology for the BGM (background music), sound effects, etc. used in a game.

2. Description of the Related Art

In conventional home video games, the main program which performs the primary game processing; the digital audio signals for reproducing BGM, sound effects, etc.; the control program for controlling the operation of the audio processor; etc. are recorded in an optical disk medium which stores the game software. The game apparatus reads the game software from the optical disk medium, develops it in the main memory, and performs game processing in response to keyed input operations of the player. In this game processing, the orchestration of acoustic effects is accomplished by outputting BGM, sound effects, etc. at the appropriate timing. The method of outputting BGM in a game is, for example, to switch the outputted BGM matched to game timing, such as when the game scene changes, when an enemy character is shot down, or when the player's game character gets a power boost, etc. Conventionally, whenever BGM is switched, a method is used whereby the BGM is faded out, its output volume gradually being lowered, while the BGM to be newly reproduced is faded in, its output volume gradually being increased.

However, if the outputted BGM is forcefully switched, matched to game timing, such as at the change of a game scene, BGM switching with good timing from a musical standpoint cannot be done. For example, in the case that a game scene changes in the middle of a musical bar of the BGM being reproduced, if the BGM is switched in the middle of the bar, that will result in an unpleasant feeling musically. Likewise, BGM switching through fading in or fading out hinders a continuous musical linking and can cause the player to feel some strangeness. Moreover, it is not easy to prepare a plurality of BGM pieces matched to game scenes, so in general a procedure is adopted whereby a few BGM pieces are used repeatedly in each game scene.

To deal with this, an object of the present invention is to provide a technology which outputs an audio signal that has no unnatural feeling whenever an audio signal, reproduced and outputted, is switched. This is done by switching at a timing that is musically appropriate. In addition, a subject of the invention is to provide technology for rich musical expression, by combining data streams. This is done by turning on and off, according to the game scene, some of the plurality of data streams which make up a single BGM piece.

SUMMARY OF THE INVENTION

To achieve the above object, the audio signal outputting method of the present invention, captures the progress (timing) of the musical piece for each of a plurality of data streams, which are mutually synchronized musically. When an event which changes the audio signal being reproduced and outputted occurs, the method selects, from among above-mentioned plurality of data streams, a data stream combination corresponding to that event, doing so at a timing where there is a musical break, and reproduces and outputs the audio signal. By means of this method, the audio signal is changed at a musically appropriate timing.

In addition, according to the present invention, it is possible to record on a computer-readable recording medium, a program for causing a computer system to execute the above-mentioned audio signal outputting method. As examples of this kind of recording medium, there are portable recording media, such as optical recording media (recording media from which data may be read optically, such as CD-RAM, CD-ROM, DVD-RAM, DVD-ROM, DVD-R, PD disk, MD disk, MO disk, etc.); magnetic recording media (recording media from which data may be read magnetically, such as flexible disk, magnetic card, magnetic tape, etc.); memory cartridges having memory elements (semiconductor memory elements such as DRAM's, and high dielectric memory elements, such as FRAM's).

In addition, the above-mentioned program can be delivered "on-demand" from a network server, such as a Web server and the like, in response to a request from a client device (a personal computer, a game machine, or a portable terminal such as a portable telephone, a personal digital assistance (PDA), or a Palm-type PC, with a Web browser incorporated) connected to an open network, such as the Internet, a packet communication network, or the like.

DESCRIPTION OF THE PROFFERED EMBODIMENTS

Below, embodiments will be described, referring to the figures.

Figure 1:
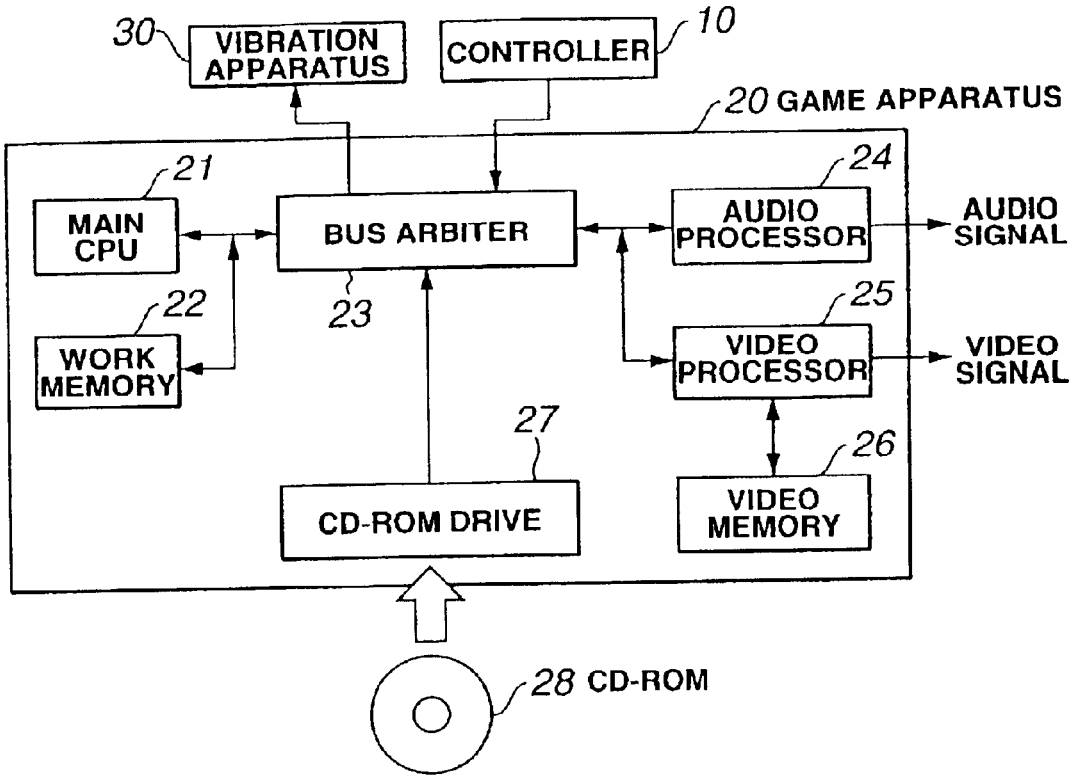
FIG. 1 is a block diagram of a game apparatus.

FIG. 1 is a block diagram of a game apparatus. As shown in the figure, game apparatus 20 is a computer system comprising main CPU 21, work memory 22, bus arbiter 23, audio processor 24, video processor 25, video memory 26, and CD-ROM drive 27. Main CPU 21 reads game software supplied from CD-ROM 28 via CD-ROM drive 27 and develops it in work memory 22. Then, based on various operation signals outputted from controller 10 via bus arbiter 23, game processing is performed, and the appearance formed in virtual space is converted to an image viewed from the chosen viewpoint and plotting commands are issued to the video processor 25. Following those plotting commands, video processor 25 performs rendering of the polygons and, by means of double buffering, writes the graphic data for the next frame into video memory 26. At the same time, it reads out graphic data for the current frame, performs a D/A conversion, and generates a video signal.

64 channels worth of MIDI (Musical Instrument Digital Interface) messages for outputting BGM are stored in CD-ROM 28. Each of these MIDI messages includes messages such as Note On, Note Off, Polyphonic Key Pressure, Control Change, Program Change, Channel Pressure, and Pitch Bend Change, as well as channel voice messages formed from additional data, such as key number, controller number, program number, pressure value, variable amount (course), velocity, and pressure. Main CPU 21 reads the MIDI messages of all channels, develops them in work memory 22, and for each data stream, captures (tracks) the reproduction timing by counting the clock tick number which finely divides into a specified number the beat that regulates the reproduction timing of the BGM.

Figure 2:
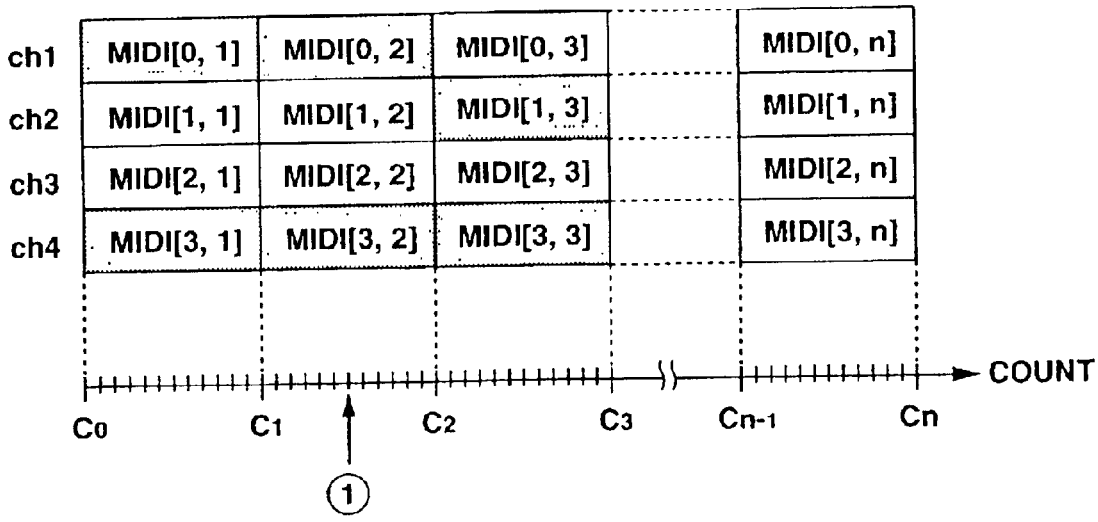
FIG. 2 is an explanatory diagram of a MIDI messages for reproducing BGM.

FIG. 2 is an explanatory diagram of the MIDI messages for reproducing BGM. To simplify the explanation, in the following explanation, the number of MIDI channels has been set at 4. In the same figure, each channel is a MIDI message for a different melody: channel 1 expresses melody 1, channel 2 expresses melody 2, channel 3 expresses melody 3, and channel 4 expresses melody 4. The MIDI message for each channel is configured of MIDI data for each bar. For example, the MIDI message of channel 1 is comprised of MIDI [01], MIDI [02], MIDI [03], . . . , MIDI [On]. There, MIDI [n−1, m] indicates the MIDI data for the $m^{th}$ bar of channel n. In addition, as shown in the same figure, the first clock tick number of the first bar is indicated by $c_0$, the first clock tick number of the second bar is indicated by $c_1$, . . . , and the first clock tick number of the $n^{th}$ bar is indicated by $c_{n-1}$.

From the 4 channels of MIDI messages, main CPU 21 selects MIDI data to be actually reproduced and outputted and transmits it to audio processor 24. The MIDI data transmitted from main CPU 21 to audio processor 24 is MIDI data which has 1 bar as its basic unit. In the figure, two channels of MIDI data are transmitted. Audio processor 24 is equipped with a MIDI sound source and reproduces an audio signal for line-out output from the MIDI data of MIDI [i−1, k] and MIDI [j−1, k] transmitted from main CPU 21.

Figures 3, 4, 5:
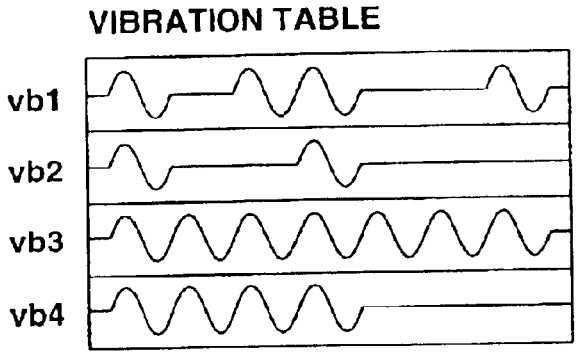
FIG. 3 is an explanatory diagram of a waveform table.
FIG. 4 is an explanatory diagram of an event table.
FIG. 5 is an explanatory diagram of a muting table.

In addition, as shown in FIG. 3, a vibration table is provided in CD-ROM 28. This vibration table is one in which vibration waveforms for causing vibration apparatus 30 to vibrate are recorded. The vibration table includes four waveform patterns: vb1, vb2, vb3, and vb4. Main CPU 21 reads the vibration table from CD-ROM 28 and develops it in work memory 22. Further, as will be explained later, when a specified event occur, the CPU reads the waveform data corresponding to that event and outputs it to vibration apparatus 30 via bus arbiter 23. Vibration apparatus 30 incorporates a drive motor having an eccentric weight attached to its drive shaft for causing vibration and, driving the vibration motor based on waveform data supplied from main CPU 21, it outputs vibration corresponding to the waveform pattern. This vibration apparatus 30 is a portable vibration generating apparatus and is used by the player by holding it between his thighs, under his arm, in his palm, for example. As explained later, because it vibrates in response to the occurrence of an event, it can give the player a stimulus of the appropriate level, enabling him to enjoy the game more.

With the present embodiment, when a certain event that is the trigger for a change in BGM reproduction/output is detected, the BGM and the vibration pattern are changed according to the type of the event. FIG. 4 is an event table which shows muting operators allocated according to the types of events and the correspondence relationship of the vibration patterns. The muting operator is an operator for producing a logical calculation in the muting table to change the BGM reproduced and outputted from audio processor 24. As shown in FIG. 5, in the muting table, for each MIDI message of the four channels, "1" is for "active" and "0" is for "inactive." In the same figure, because the muting table shows "1001," channel 1 and channel 4 are active. Main CPU 21, referring to the muting table, transmits to audio processor 24 the MIDI data which has been made active. To describe this state, using FIG. 2, audio processor 24 reproduces and outputs MIDI [0,1] and MIDI [3,1] for the period when clock tick number is from $c_0$ to $c_1$ and reproduces and outputs MIDI [0,2] and MIDI [3,2] for the period when clock tick number is from $c_1$ to $c_2$.

Here, suppose that event 2 occurred at timing ℵ in the same figure. When the event occurs, main CPU 21 sets the event flag to "1". Then, in the state where the event flag is set to "1", when the clock tick number which the counter is counting reaches $c_2$, main CPU 21, referring to the event table, changes the MIDI message and vibration pattern which are active. Here, referring to FIG. 4, for event 2, the corresponding muting operator is "1100" and the vibration pattern is "vb2", so main CPU 21 performs a logical calculation on "1001" in the muting table and changes the muting table value. The CPU also outputs the waveform data of vibration pattern "vb2" to vibration apparatus 30. Here, if an exclusive logical sum is used as the logical calculation, the exclusive logical sum of "1001" and "1100" becomes "0101". As a result, the MIDI messages which are active for the period from clock tick number $c_2$ to $c_3$ become channel 2 and channel 4, and audio processor 24 reproduces and outputs MIDI [1,3] and MIDI [3,3].

Further, the issue of how to set the muting operator is completely at the user's discretion, and it can be set to change the BGM corresponding to various events which occur as the game is developed. For example, when the game is progressing in a way favorable to the player, a major key may be used, while when game progress is not to the advantage of the player, a minor key is used, and, in the case of a good thing happening to the player, bright chords can be used more. Likewise, when the game progress has become monotonous, few chord changes are made, while in the case of fast-paced player activity, the tempo may be speeded up. In cases where the game has settled down, the tempo can be slowed, while for scenes where complex operations are required of the player, complicated musical pieces can be used. Bright melodies are selected for cases where the player's game character transitions to a bright stage, while when he moves to a dark stage, solemn melodies may be selected. When the player's game character is surrounded by enemy characters, a melody can be selected which gives a feeling of tension, while when he breaks out from being surrounded by those enemy characters, a cheerful melody is selected. When the player's game character enters a narrow place, the degree of applying echo or other effects may be increased, while when the player's game character goes out into an open place, the degree of applying echo or other effects can be reduced. Moreover, the muting operator can be set to change the tempo, key, chords, rhythm pattern, and so on matched to the movements of the player's game character, such as when he gets up, changes the direction of his movement, jumps, receives damage, gains an "item," uses the item, makes a violent movement, moves slowly, rolls along, makes tiny movements, makes grand movements, falls down, or when an enemy character brandishes his sword, or when the player corners on a road course, etc.

In addition, MIDI messages may be allocated to each channel such that of the 64 channels, channel 1 through channel 16 are melodies for use by the player's game character, channel 17 through channel 32 are rhythms for use by the player's game character, channel 33 through channel 48 are melodies for use by enemy characters, and channels 49 through 64 are rhythms for use by enemy characters. Similarly, in regard to vibration patterns, each kind of vibration pattern can be set according to the game situation, etc. at the time an event occurs.

Figure 6:
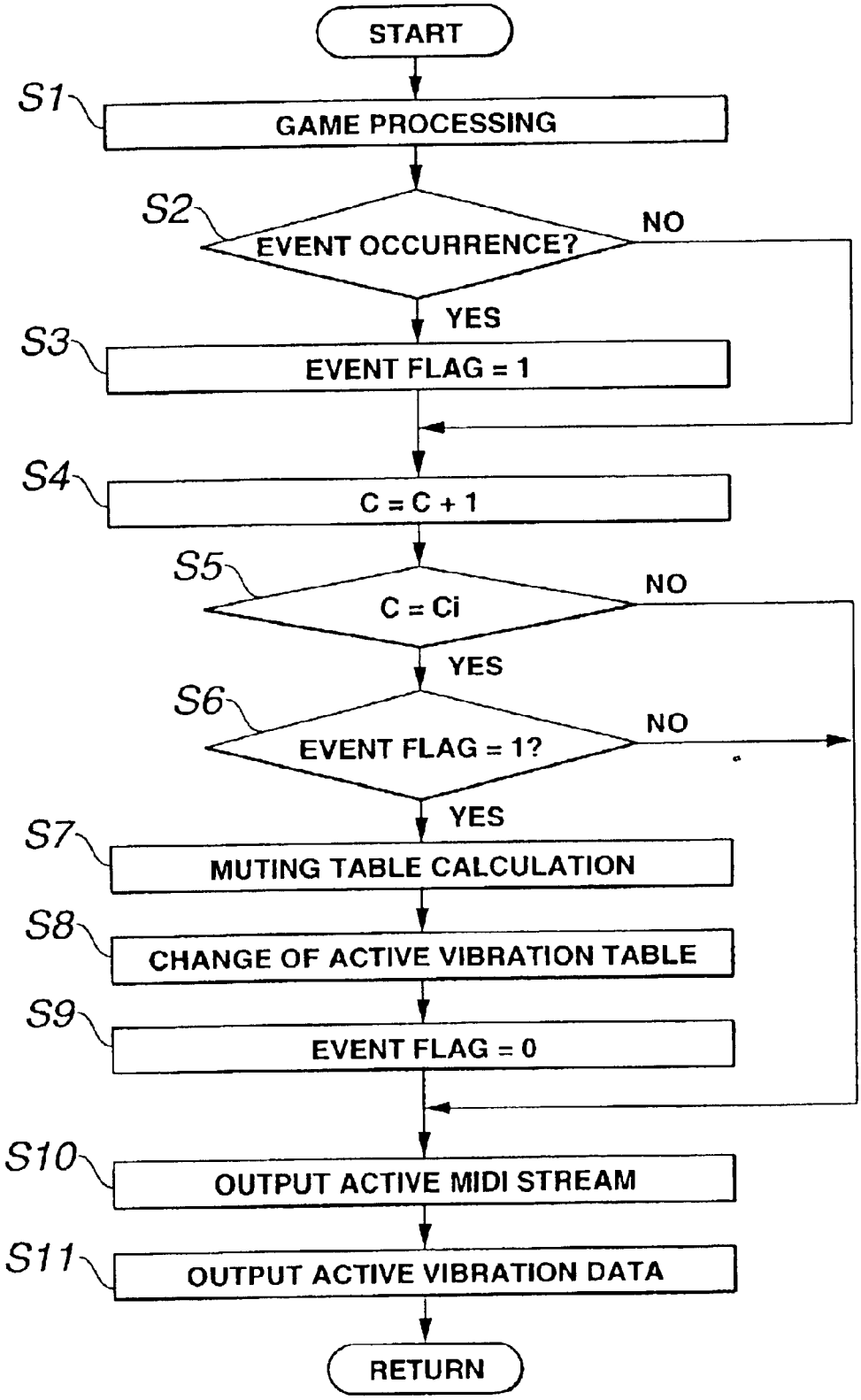
FIG. 6 is a flow chart indicating the steps in reproducing BGM.

Next, the specific steps for changing BGM in response to an event are described. FIG. 6 is a flow chart indicating those steps. Main CPU 21 performs the processing steps indicated in that flow chart each $1/60^{th}$ of a second, which is the graphic updating period. Main CPU 21, responsive to the player's input operations, performs the specified game processing (S1) and checks whether there has been an event occurrence (S2). If an event occurrence is detected (S2: YES), the event flag is set to "1" (S3), while if an event occurrence is not detected (S2: NO), the event flag remains "0", and the value of the clock tick number, c, which the counter counts is increased by 1 (S4). Here, in the case when counter value c is equal to $c_i$ (i=0 to n) (S5: YES) and the case that the event flag has been set to "1" (S6: YES), muting table processing is performed, referring to the event table (S7). Further, the active vibration table is changed (S8) and the event flag is reset to "0" (S9).

Then, main CPU 21 outputs the active MIDI data to audio processor 24 (S10) and, in addition, the active vibration data is outputted to vibration apparatus 30 (S11). On the other hand, in the case that the counter value is not equal to $c_1$ (i=0 through n) (S5: NO) and the event flag is set to "0" (S6: NO), the above-mentioned processing steps S10 and S11 are performed.

In this way, according to the present invention, BGM is not changed abruptly upon occurrence of an event, but, by changing the BGM output based on divisions with 1 musical bar as a unit, a BGM output method can be achieved with no sense of musical unnaturalness. In addition, the vibration pattern of vibration apparatus 30 can be changed in synchronization with the BGM change, so that a set rhythm for the acoustic changes and the vibration changes can be achieved.

Note that the audio signal outputting method of the present invention can be applied not only to BGM outputting methods, but also to outputting methods for various kinds of audio signals. Further, the data stream for reproducing audio signals need not be limited to MIDI data, but may be any desired sound data such as WAV data, AIFF data, MP3 data, RAW data, WMA data, etc.

What is claimed is:

1. An audio signal outputting method comprising the steps of:

capturing a progress timing for each of a plurality of data streams representing a plurality of musical pieces having at least one musical break, said data streams being mutually synchronized musically;

detecting an occurrence of an event that changes an audio signal to be reproduced and outputted; and upon detection of said event occurrence, reproducing and outputting the audio signal by selecting from said plurality of data streams a combination of data streams corresponding to said event, at a time when there is the at least one musical break.

2. An audio signal outputting method comprising the steps of:

capturing a progress timing for a plurality of MIDI messages of multiple channels representing a plurality of musical pieces having at least one musical break, said MIDI messages being mutually synchronized musically;

detecting an occurrence of an event that changes the audio signal to be reproduced and outputted; and upon detection of said event occurrence, reproducing and outputting the audio signal by selecting from said plurality of MIDI messages a combination of MIDI messages corresponding to said event, at a time when there is the at least one musical break.

3. The audio signal outputting method according to claim 1, wherein said time when there is the at least one musical break involves at least a break of musical bars or a break in a rhythm, following said event occurrence.

4. The audio signal outputting method according to claim 1, wherein said audio signal is a sound effect in a game.

5. The audio signal outputting method according to claim 1 wherein said event is an event that causes a change in a progression of a game.

6. The audio signal outputting method according to claim 1, wherein a waveform data for driving a vibration apparatus is changed at a time when there is the at least one musical break.

7. A computer program product in which a program for causing a computer system to execute game processing is recorded on a computer-readable recording medium, wherein said computer program uses execution of the steps of:

capturing a progress timing for each of a plurality of data streams representing a plurality of musical pieces having at least one musical break, said data streams being mutually synchronized musically;

detecting an occurrence of an event that changes an audio signal to be reproduced and outputted; and upon detection of said event occurrence, reproducing and outputting the audio signal by selecting from said plurality of data streams a combination of data streams corresponding to said event, at a time when there is the at least one musical break.

8. A computer program product in which a program for causing a computer system to execute game processing is recorded on a computer-readable recording medium, wherein said computer program uses execution of the steps of:

capturing a progress timing for each a plurality of MIDI messages of multiple channels representing a plurality of musical pieces having at least one musical break, said MIDI messages being mutually synchronized musically;

detecting an occurrence of an event that changes an audio signal to be reproduced and outputted; and upon detection of said event occurrence, reproducing and outputting the audio signal by selecting from said plurality of MIDI messages a combination of MIDI messages corresponding to said event, at a time when there is the at least one musical break.

9. The computer program product according to claim 7, wherein said time when there is the at least one musical break involves at least either a break of musical bars or a break in a rhythm, following said event occurrence.

10. The computer program product according to claim 7, wherein said audio signal is a sound effect in a game.

11. The computer program product according to claim 7, wherein said event is an event that causes a change in a progression of the game.

12. The computer program product according to claim 7, wherein the computer program also causes execution of a step of changing a waveform data for driving a vibration apparatus at a time when there is the at least one musical break.

13. An audio signal outputting apparatus comprising:

means for capturing a progress timing of each of a plurality of data streams representing a plurality of musical pieces having at least one musical break, said data streams being mutually synchronized musically;

means for detecting an occurrence of an event that changes an audio signal to be reproduced and outputted; and means for reproducing and outputting an acoustic signal by selecting from said plurality of data streams a combination of data streams corresponding to said event upon detection of said event occurrence, at a time when there is the at least one musical break.

* * * * *